US008161667B2

(12) United States Patent
Hwang

(10) Patent No.: US 8,161,667 B2
(45) Date of Patent: Apr. 24, 2012

(54) ELASTIC SOLE AND ITS SHOES HAVING ELASTIC REACTION FORCE AND SHOCK ABSORPTION

(75) Inventor: Young Sun Hwang, Busan (KR)

(73) Assignee: Boss Corporation (KR)

( * ) Notice: Subject to any disclaimer, the term of this patent is extended or adjusted under 35 U.S.C. 154(b) by 140 days.

(21) Appl. No.: 12/621,384

(22) Filed: Nov. 18, 2009

(65) Prior Publication Data

US 2010/0058617 A1 Mar. 11, 2010

Related U.S. Application Data

(63) Continuation of application No. PCT/KR2008/000596, filed on Jan. 31, 2008.

(30) Foreign Application Priority Data

Dec. 12, 2007 (KR) ..... 10-2007-0128698

(51) Int. Cl.
*A43B 13/18* (2006.01)
*A43B 13/00* (2006.01)

(52) U.S. Cl. ..... 36/102; 36/28; 36/35 R

(58) Field of Classification Search ..... 36/28, 27, 36/37, 29, 103, 35 R, 30 R, 15, 102, 43
See application file for complete search history.

(56) References Cited

U.S. PATENT DOCUMENTS

| | | | | | |
|---|---|---|---|---|---|
| 2,814,132 | A * | 11/1957 | Montoscuro | ..... | 36/37 |
| 4,492,046 | A * | 1/1985 | Kosova | ..... | 36/27 |
| 5,138,776 | A | 8/1992 | Levin | | |
| 5,875,567 | A * | 3/1999 | Bayley | ..... | 36/27 |
| 6,247,249 | B1 * | 6/2001 | Lindqvist | ..... | 36/28 |
| 6,557,271 | B1 * | 5/2003 | Weaver, III | ..... | 36/27 |
| 6,832,612 | B2 * | 12/2004 | Zhao et al. | ..... | 131/334 |
| 6,925,732 | B1 * | 8/2005 | Clarke | ..... | 36/27 |
| 2005/0102859 | A1 * | 5/2005 | Yen | ..... | 36/28 |
| 2006/0130362 | A1 * | 6/2006 | Juan | ..... | 36/27 |

FOREIGN PATENT DOCUMENTS

| | | | |
|---|---|---|---|
| JP | 05-293001 | A | 11/1993 |
| JP | 2007-185453 | A | 7/2007 |
| KR | 20-1988-0022623 | U | 5/1991 |
| KR | 20-0196722 | Y1 | 9/2000 |

OTHER PUBLICATIONS

International Search Report/ PCT/KR2008/00596.

* cited by examiner

*Primary Examiner* — Jila Mohandesi
(74) *Attorney, Agent, or Firm* — Park & Associates IP Law, P.C.

(57) ABSTRACT

Disclosed are an elastic sole member which optimizes between a shock absorbing function and repulsive elastic force, between which a tradeoff relationship exists, and a shoe with the elastic sole member. The elastic sole member includes a sole body which is upwardly inclined toward a back end thereof, and an elastic member comprised of a fixing piece inserted through and fixed in a space formed through an upwardly inclined back portion of the sole body, and an elastic plate extending from the fixing plate while it is downwardly inclined and having a first end exposed to the outside and a second end spaced apart from the sole body, in which the elastic sole member elastically contracts when external force is applied to a back portion of the sole body while the fixing piece serves as the elastic support axis and provides elastic recovery force when the external force is removed.

19 Claims, 3 Drawing Sheets

ELASTIC SOLE AND ITS SHOES HAVING ELASTIC REACTION FORCE AND SHOCK ABSORPTION

REFERENCE TO RELATED APPLICATIONS

This is a continuation of pending International Patent Application PCT/KR2008/000596 filed on Jan. 31, 2008, which designates the United States and claims priority of Korean Patent Application No. 10-2007-0128698 filed on Dec. 12, 2007, the entire contents of which are incorporated herein by reference.

FIELD OF THE INVENTION

The present invention relates to a functional shoe, and more particularly to a functional shoe having an elastic sole member which makes a wearer feel comfortable when he or she wears the shoe thanks to a symmetric shock absorbing function and an elastic reaction.

BACKGROUND OF THE INVENTION

Generally, shoes are used for the protection of wearers' feet. The shoes isolate and protect the wearers' feet from the environment when the wearers walk or run while wearing the shoes.

The average person takes about 6000 steps a day, which loads the feet of the walker with 432 tons, or over 400 tons, the approximate weight of an international jetliner.

The simplest way of developing a good shoe, which can absorb shocks applied to the sole of a wearer's foot, is to reduce the hardness of the shoe. When the term "cushion" is defined as a soft pad that reduces the maximum force, the term "good cushion" is defined as a soft pad that absorbs a sufficient amount of a shock so that the skeletal muscle system of the wearer is not damaged. However, besides cushioning, since actuating force is an important factor determining athletic performance, it is not necessarily desirable for a cushion system to absorb all of the force, in the interest of athletic performance. That is, this is a complicated problem, and it is difficult to define the optimum hardness of a shoe for absorbing a shock generated in reaction to skeletal muscle exertion. That is, information about the magnitude of the force is required in order to calculate the optimum hardness.

As the result of analysis of surface repulsive power using a pressure plate while running, the vertical magnitude of force between the surface of the ground and the foot of a runner has been determined to be two to three times the weight of the user. Considering that both feet of the runner contact the surface of ground, that a runner takes about 1000 steps per 100 meters, and that a magnitude of force as strong as two to three times the weight of the runner is repetitively applied to the runner's feet, if shocks are not sufficiently absorbed, runner's joints may degenerate, leading to lumbago. Accordingly, good running shoes that can absorb shocks are needed.

However, there is a trade-off between the shock absorbing function needed at the time of landing the foot on the ground and the repulsive elastic function needed at the time of separating the foot from the ground. If greater importance is placed on one of the two functions, the other function is somewhat compromised.

FIG. 1 shows the positions of the runner's foot and parts of the foot to which shocks are applied when the foot contacts the ground. FIG. 1(*a*) shows the position in which the back part of the sole of the runner's foot contacts the ground. In this case, the magnitude of a shock is greater than the runner's weight for the first 20 to 30 ms. In detail, the magnitude of a shock is equal to about 2.2 times the runner's weight. FIG. 2(*b*) shows the position in which the entire sole of the runner's foot contacts the ground after the back part contacts the ground. In this case, the upward power which supports the foot is greater than the runner's weight. FIG. 1(*c*) shows the position in which the front part of the sole of the runner's foot contacts the ground to prepare for the start of the next running step. The front part of the sole stays on the ground for about 100 ms and then leaves the ground. At this time, the front part of the sole is applied with a load equal to 2.8 times the runner's weight.

From the above, it can be seen that the total magnitude of shock applied to the sole of a runner or a walker is much greater than one would think. Accordingly, a variety of shock absorbing members, such as sponge foam, have been used in order to alleviate the magnitude of the shock. However, when such shock absorbing members are used, other problems arise. That is, although such shock absorbing members can absorb shocks somewhat, they also reduce the ground repulsive power, making running or walking difficult.

That is, in the structure of a shoe, the shock absorbing function, which must be strong when a wearer's foot lands on the ground, and the elastic repulsive power, which must be strong when the wearer's foot leaves the ground, are in a conflicting relationship. That is, if either one becomes stronger, the other one becomes weaker.

SUMMARY OF THE INVENTION

The invention has been made in view of the above-mentioned problems, and thus an object of the invention is to provide a functional shoe that can absorb as great a shock as possible when a wearer's foots lands on the ground and also has a satisfactory elastic repulsive power when the wearer's foot leaves the ground. That is, the functional shoe of the invention has both a good shock absorbing function and good elastic repulsive power.

In order to accomplish the object of the invention, according to one aspect of the invention, there is provided a shoe having a sole which contacts the ground surface. The shoe is provided with an elastic sole member having a shock absorbing function and repulsive elastic force. The elastic sole member includes an elastic member having a flat panel shape having elastic force in response to external force, and an end portion of the elastic member is inserted in and fixed to the sole body and forms an elastic support axis. The elastic sole member elastically contracts and elastically recovers in response to changes in external force.

The elastic sole member includes a sole body, which is inclined upward toward the back end thereof, and an elastic member comprised of a fixing piece inserted in and fixed to the lower surface of the upwardly inclined back portion of the sole body, and an elastic plate extending from the fixing piece, being downwardly inclined and exposed to the outside, having a first end exposed to the outside and a second end spaced apart from the sole body. The elastic sole member elastically contracts when external force is applied to the back portion of the sole body while the fixing piece serves as the elastic support axis and elastically recovers when the external force is removed.

It is preferable that the elastic member be made of metal or synthetic resin. Moreover, it is preferable that the outer surface of the elastic member be coated with rubber or soft synthetic resin.

It is preferable that the elastic sole member further includes a backside sole on which the elastic sole is disposed, and a support member inserted between the elastic plate of the elastic member and the upwardly inclined back portion of the sole body. The support member may engage with the sole body in a manner such that a protruding jaw is formed on the surface of the upwardly inclined back portion of the sole body and an end of the support member is hooked by the protruding jaw. It is preferable that an auxiliary elastic member having elasticity be provided in a space disposed at the back of the support member and between the elastic member and the sole body.

It is preferable that the sole body have an entrance at the upwardly inclined back portion thereof and a space which communicates with the entrance. It is preferable that the fixing piece of the elastic member be received and fixed in the space. It is preferable that the sole body further include an insole disposed on the upper surface thereof. It is preferable that the fixing piece be fixed to the sole body in a threaded manner through a window disposed on the upper surface of the space of the sole body.

According to another aspect of the invention, there is provided a shoe having a sole which contacts the ground surface, in which the sole includes a sole body, which is upwardly inclined toward a back end portion thereof, and an elastic member comprised of a fixing piece inserted in and fixed in part of the upwardly inclined space of the sole body, and an elastic plate extending from the fixing piece at a downward incline and having an end spaced apart from the sole body, and an insole disposed on the upper surface of the sole body. The elastic sole member has a shock absorbing function and repulsive elastic force in a manner such that the sole elastically contracts when external force is applied to the back portion of the sole body while the fixing piece serves as the elastic support axis and elastically recovers when the external force is removed.

It is preferable that the elastic member be made of metal.

It is preferable that the elastic sole member further include a backside sole on which the elastic plate is disposed, a front-side sole provided on the front lower surface of the sole body which contacts the ground surface.

It is preferable that the support member be inserted in the space between the upwardly inclined back portion of the sole body and the elastic plate of the elastic member. It is preferable that a protruding jaw be provided on the surface of the upwardly inclined back portion of the sole body and that an end of the support member engages with the protruding jaw. It is preferable that an auxiliary elastic member be further provided in the space formed between the elastic member and the sole body.

It is preferable that the sole body be provided with an entrance at the upwardly inclined back portion thereof and with a space which communicates with the entrance. It is preferable that the fixing piece of the elastic member be received and fixed in the space of the sole body.

ADVANTAGEOUS EFFECTS

As described above, the shoe according to the invention has advantageous effects in that it is possible to absorb a shock applied to the wearer's heel part when the wearer walks and to reduce the decrease in the elastic repulsive power, which is helpful when a wearer walks, and in addition, it is possible to give a sense of stability to the wearer.

BRIEF DESCRIPTION OF KEY ELEMENTS IN DRAWINGS

| | | | |
|---|---|---|---|
| 10: | Elastic sole member | 20: | Sole member body |
| 20a: | Front part | 20b: | Back part |
| 22: | Space portion | 22a: | Entrance portion |
| 30: | Elastic member | 32: | Fixing piece |
| 32a: | Threaded hole | 32b: | Threaded insertion member |
| 34: | Elastic plate | | |
| 40: | Support member | 45: | Auxiliary elastic member |
| 50: | Outsole | 60: | Insole |

DETAILED DESCRIPTION OF THE INVENTION

Figure 1:
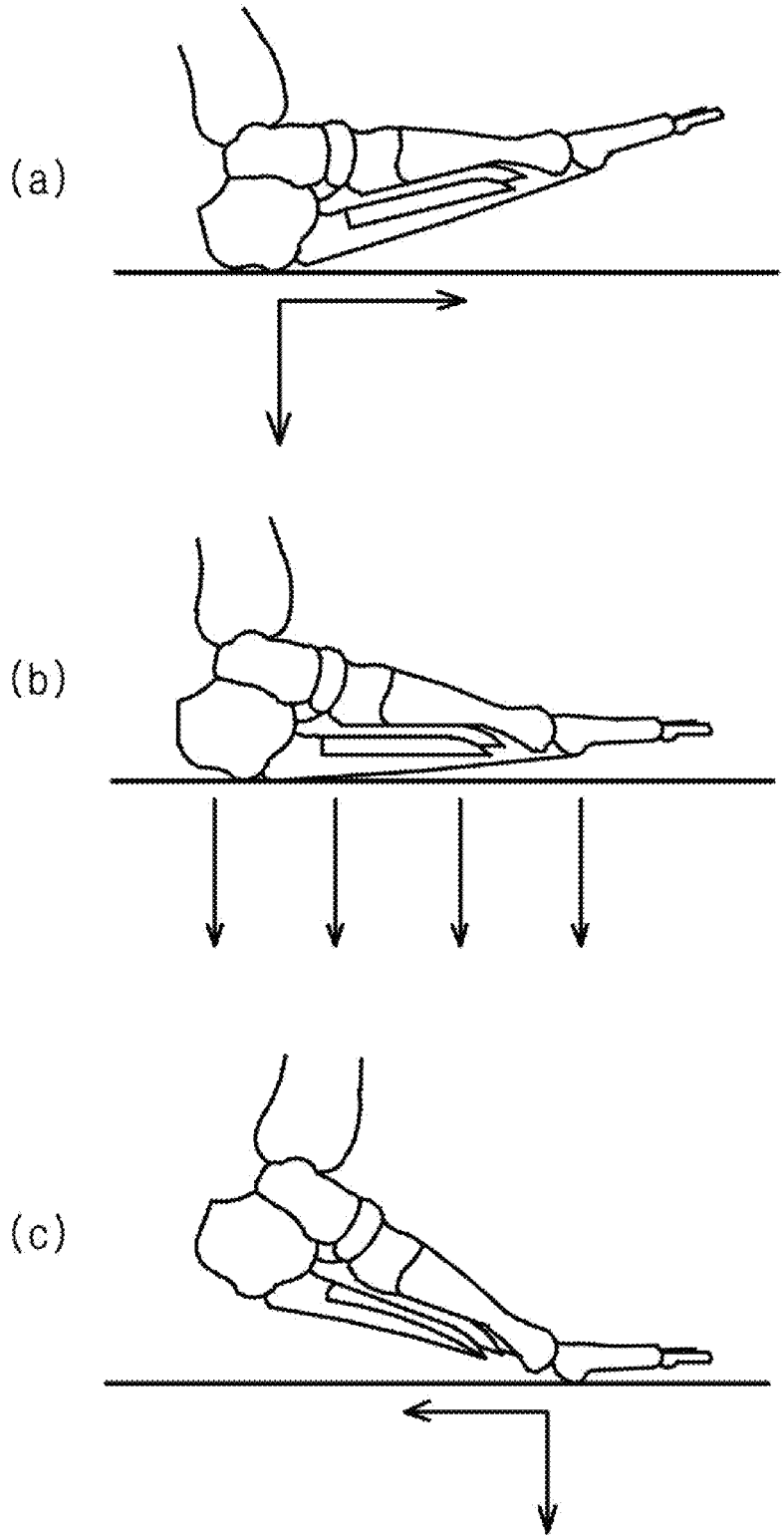
FIG. 1 is a schematic view illustrating the parts of the foot to which shocks are intensively applied when walking or running.
Figure 2:
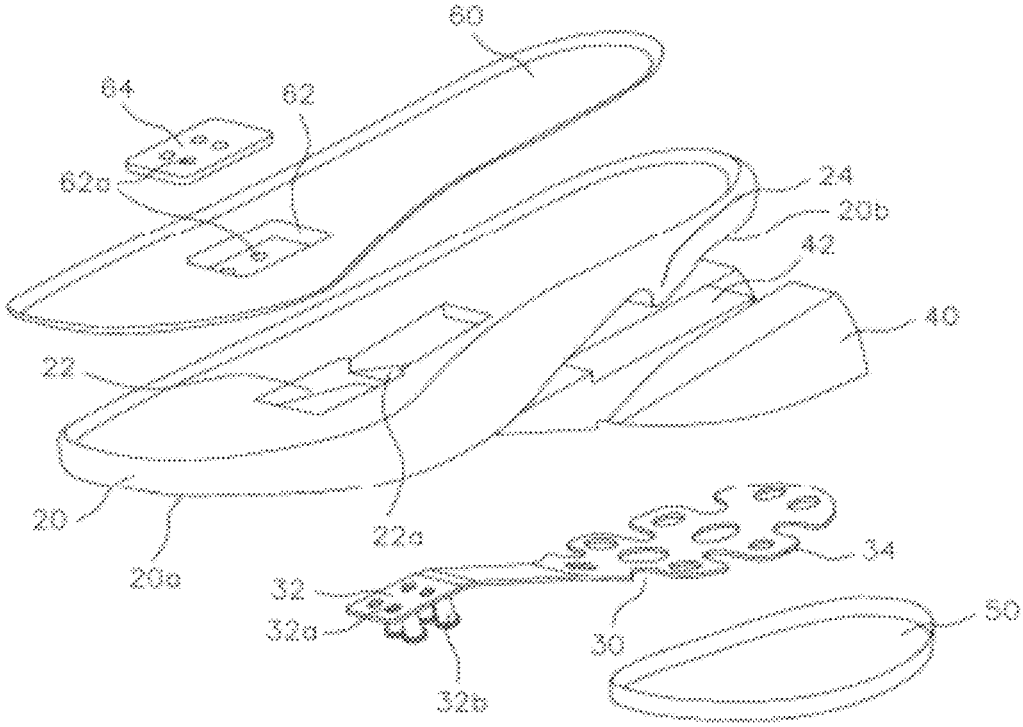
FIG. 2 is an exploded perspective view illustrating an elastic sole member according to one embodiment of the invention.
Figure 3:
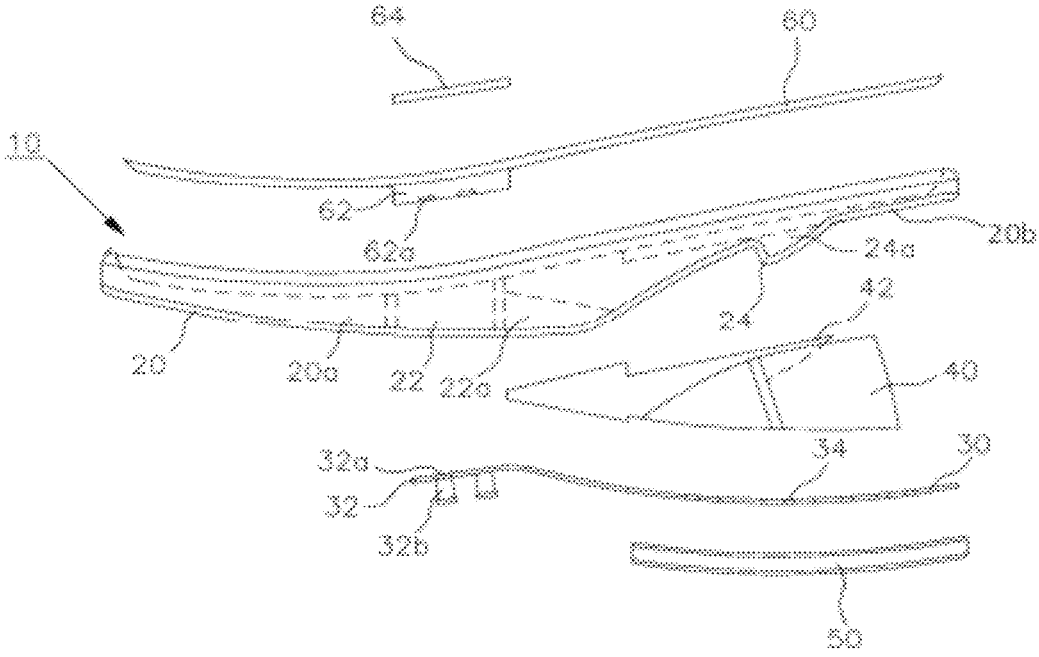
FIG. 3 is an exploded side perspective view illustrating an elastic sole member according to one embodiment of the invention.
Figure 4:
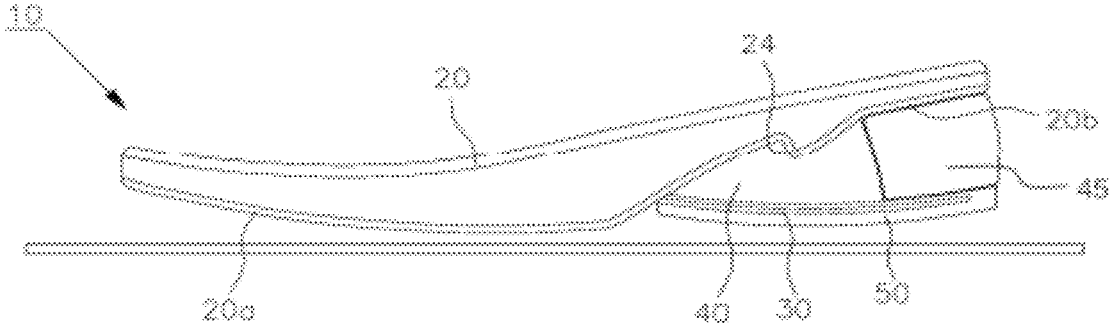
FIG. 4 is a side view illustrating an elastic sole member according to one embodiment of the invention.
Figure 5:
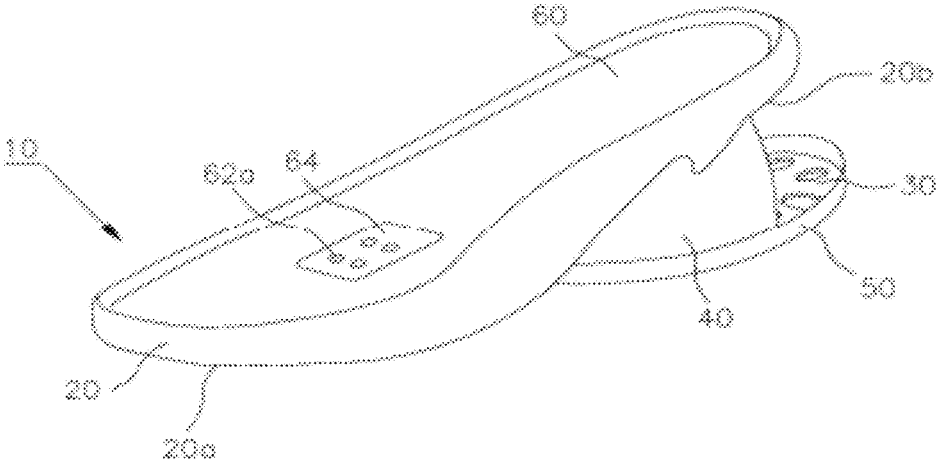
FIG. 5 is a perspective view illustrating an elastic sole member according to one embodiment of the invention.

A functional shoe of the present invention having the above-described advantageous effect will be described in greater detail below with reference to the accompanying drawings. FIG. 2 is an exploded perspective view illustrating an elastic sole of a shoe according to one embodiment of the invention, FIG. 3 is a side perspective view illustrating the elastic sole of a shoe according to one embodiment of the invention, FIG. 4 is a side view illustrating the elastic sole of a shoe according to one embodiment of the invention, and FIG. 5 is a perspective view illustrating the elastic sole according to the invention.

As shown in FIGS. 2 to 5, the invention relates to a sole of a shoe, but not to the upper of a shoe, which covers the top of the foot. Hereinafter, the term "elastic sole" is the general term representing the combination of an outsole, a midsole, and an insole, which are elements of a shoe excluding the upper of the shoe.

The elastic sole member 10 of the invention includes a sole body 20, an elastic member 30, and a support member in one aspect, and also includes an outsole 50 and an insole 60 in another aspect.

The sole body 20 will be explained first. The sole body 20 is a means which functions as a midsole in an ordinary shoe and is structured to be inclined upward toward the back end according to the embodiment of the invention. That is, the part from the midway point to the heel is formed to be gradually upwardly inclined with a curve, so the sole body 20 includes a front part 20*a*, which contacts the ground, and a back part 20*b*, which does not contact the ground. The back part 20*b* has an open entrance portion 22*a* at a portion thereof, and the front part 20*a* has an empty space 22 which communicates with the open entrance portion 22*a*. The upper portion of the space 22 is open. The entrance portion 22*a* and the space 22 are coupled with an elastic member 30, which will be described later, and thus serve as an elastic support of the elastic member 30. Meanwhile, a protruding jaw 24 is provided at the back part 20*b* of the sole body 20 and is spaced apart from the entrance portion 22*a*. The protruding jaw 24 has a protruding jaw space 24*a* inside it. The protruding jaw 24 and the protruding jaw space 24*a* will be combined with a support member 40, which will be described later.

Since the sole body 20 is an element which functions as an outsole or a midsole in an ordinary shoe, it is satisfactory if the sole body 20 is made of synthetic resin which is used in manufacturing a general shoe sole, such as rubber, urethane resin, or ethylene vinyl acetate.

Hereinafter, the elastic member 30 will be described. The elastic member 30 includes a fixing piece 32, which serves as a support center of the elastic member 30, and an elastic plate 34, the form of which is elastically changed by external force to provide an elastic reaction. The elastic plate 34 generally functions as a leaf spring. The fixing piece 32 has a flat rectangular shape and is provided with a plurality of threaded holes 32*a*. Threaded insertion members 32*b* are engaged with respective threaded holes 32*a* from the underside. The fixing piece 32 is placed in the space 22 passing through the entrance portion 22*a* provided to the back part 20*b* of the sole body 20, and then the threaded insertion members 32*b* engage with the threaded holes 32*a* so that the fixing piece 32 is securely fixed to the sole body 20. This embodiment has a structure in which the threaded holes 32*a* and the threaded insertion members 32*b* engage with each other, but alternatively, there may be another structure in which the threaded holes 32*a* are provided, but the threaded manner can be achieved without the use of the threaded insertion members. Further, the bottom surface of the fixing piece 32 may be bonded to the upper surface of the space 22 in the sole body 20 using an adhesive without the use of the threaded holes 32*a*. In addition to the above mentioned methods, it is apparent that a variety of further combining methods may be used. For example, the sole body 20 may not have the space 22 but may have the entrance portion 22*a* which is long, and the fixing piece 32 is inserted into the long entrance portion 22*a*. Then, the fixing piece 32 is combined with the sole body 20 through a variety of methods, such as a threaded manner and a bonding manner. The important point of the invention is that the fixing piece 32 is securely combined with the sole body 20 so that the fixing piece 32 functions as the elastic support center axis. Accordingly, any method can be used as the combining method as long as the fixing piece 32 can be combined with the sole body 20.

Hereinafter, the elastic plate 34 will be described.

The elastic plate 34 is connected with the end of the fixing piece 32. That is, the plastic plate 34 is disposed to be inclined downward from the end of the fixing piece 32 for a certain length, and then extends flat. When external force is applied to the elastic plate 34, the elastic place 34 provides elastic force while the fixing piece 32 serves as the elastic support axis. The elastic force of the elastic plate 34 will be described later.

The elastic member 30, comprising the fixing piece 32 and the elastic plate 34, functions as a leaf spring used in a shoe. Accordingly, it is manufactured taking the weight of a wearer into consideration and thus it is preferable that it be made of a metal such as aluminum and iron, which are general materials for leaf springs. Alternatively, it can be made of reinforced plastic. That is, the elastic member 30 can be made of any material, as long as it can provide elastic force.

The elastic member 30 may be coated with synthetic resin such as rubber or polyurethane. In the case in which the elastic member 30 is coated with such material, metal alteration and breaking due to excessive shocks can be prevented. Furthermore, it is possible to improve the appearance of the elastic member 30 by imparting it with a variety of colors.

Next, the outsole (bottom sole, 50) will be described before a support member 40 is described.

The outsole 50 is the part that directly contacts the ground surface, and thus it is preferable that it be made of a general outsole material having abrasion resistance and slip resistance. As shown in the drawings, with this embodiment, the outsole 50 is combined with the elastic plate 34 of the elastic member 30 and forms the back part of the elastic sole 10. That is, the elastic plate 34 is disposed on the upper surface of the back part of the outsole 50, and the elastic plate 34 and the back part of the outsole 50 are integrated. As a result, the elastic plate 34 contacts the ground surface while being spaced from the back part 20*b* of the sole body 20, and thus it functions as the heel of a shoe. Furthermore, it is apparent that an outsole is also provided under the front part 20*a* of the sole body 20. Accordingly, the outsole 50 is made of a general outsole material such as rubber, and functions as the bottom sole which contacts the ground surface.

Hereinafter, an insole 60 will be described.

The insole 60 is the part of a shoe that generally contacts the bottom of a wearer's foot. The insole 60 is bonded to the upper surface of the sole body 20. The insole 60 has a lower space portion 62 at a position corresponding to the space 22 of the sole body 20. The lower space portion 62 is provided with threaded holes 62*a*. After the fixing piece 32 of the elastic member 30 is placed in the space 22 of the sole body 20, the fixing piece 32 can be fixed to the sole body 20 in a threaded combination manner in the lower space portion 62. After all the elements are combined, a cover 64 is put on the insole to cover the lower space portion 62, and thus the threaded combined portion is not hidden under the cover 64.

Alternatively, the insole 60 does not need to be provided with the lower space portion 62, but may have a general structure such as that provided on an ordinary shoe. In this case, the fixing piece 32 is combined with the sole body 20 in the space 22 from the upper side of the sole body in a threaded manner. Further alternatively, the fixing piece 32 may be fixed in the space 22 of the sole body 20 using an adhesive.

Hereinafter, the support member 40 will be described.

The support member 40 is disposed between the sole body 20 and the elastic member 30 and supplements the elastic force of the elastic member 30. That is, the support member 40 has a wedge shape, and has a length which is shorter than the size of the back part 20*b*, which is inclined upward from the end of the front part toward the back end of the sole body 20*b*. It is preferable that the support member 40 fill about 30 to 60% of the space, in length, formed between the back part 20*b* of the sole body 20 and the elastic plate 34. The front end of the support member 40 engages with the protruding jaw 24 formed at a portion of the back part 20*b* of the sole body 20 and thus it is fixed. That is, a protrusion formed at an end of the wedge-shaped support member 40 is inserted into the protruding jaw space 24*a* formed inside the protruding jaw 24, and the surface of the end portion of the protrusion 42 is hooked by the protruding jaw 24 so that the support member 40 is closely fixed in the space between the back part 20*b* of the sole body 2—and the elastic member 30. When the support member 40 is fixed in the above-mentioned manner, the external force applied to the support member 40 is absorbed somewhat, so that elastic action is performed at the back part of the shoe, and it is possible to prevent the elastic member 30 from breaking. The support member 40 has a predetermined rigidity, and in consideration thereof, it may be made of synthetic resin.

Furthermore, an auxiliary elastic member 45 may be disposed in an empty space between the sole body 20 and the elastic member 30. The auxiliary elastic member 45 has a different function from the support member 40. With this embodiment, an empty space is formed between the back part

20*b* of the sole body 20 and the elastic member 30, and thus, due to the elastic member 30, the back part 20*b* of the sole body 20 may have elastic force with respect to the external force. The elastic force is concentrated on the back end portion (heel side) of the back part 20*b* of the sole body 20. Accordingly, in order to prevent the elastic member 30 from breaking, the wedge-shaped support member 40 is provided. On the other hand, the auxiliary elastic member 45 is provided in order to alleviate the elastic force at the back portion of the foot. That is, the auxiliary support member 45 is made of a material which is easily deformed by external shocks, such as silicon rubber, a blow-molded air bag, or a sponge, which are different from the material of the support member 40, and thus the auxiliary support member 45 softens the elastic action between the back end portion of the back part 20*b* of the sole body 20 and the elastic member 30.

Hereinafter, how the elastic sole 10 acts against the external force will be described.

When a wearer walks or runs, wearing the shoes provided with the elastic member 10 shown in FIGS. 4 and 5, the load of the wearer's weight spreads across the range of the sole from the heel to the toe. That is, when the wearer's foot lands on the ground surface at an early stage of a step, the maximum load is applied to the back end portion of the sole of the wearer's foot, and then the back end portion of the sole of the wearer's foot is lifted up for forward action, and finally the front portion of the sole of the wearer's foot contacts the ground, so that the wearer can move forward. Accordingly, when the external force, which is transferred to the back portion of the sole of the wearer's foot as the load, is sufficiently absorbed, it is possible to protect the ankle and the knee joints of the wearer. For this reason, with this invention, since the empty space is maintained between the sole body 20 and the elastic member 30, the external force attributable to the vertical load presses the back portion of the sole body 20 in the vertical direction when the vertical load is applied to the back portion of the sole of the wearer's foot when the wearer walks. At this time, since the fixing piece 32 is integrated with the sole body 20, the fixing piece 32 functions as an elastic support axis. That is, the fixing piece 32 does not drift since the fixing piece 32 is more securely combined with the sole body 20 due to the vertical load, and serves as the support axis as it contact the ground surface. The back part 20*b* of the sole body 20 receives the downward force attributable to the vertical load. At this time, since the fixing piece 32 is fixed to the sole body 20, the elastic plate 34 of the elastic member 30 receives upward elastic force thanks to the fixing piece 32 serving as the support axis due to the vertical load, and thus it is likely to move upward due to the elastic force. Accordingly, the vertical load, such as the shock transferred to the back part 20*b* of the sole body 20, is offset by the elastic force of the elastic plate 34, and thus the shock can be absorbed.

Furthermore, the support member 40 is disposed between the sole body 20 and the elastic member 30, and it remains tightly stuck between the sole body 20 and the elastic member 30. Accordingly, the external force attributable the vertical load is applied to the sole body 20 and the elastic member 30 disposed in the back of the support member 40, and thus it is possible to effectively transfer the elastic force of the elastic member 300 to the back portion of the sole of the wearer's foot. That is, as described above, the greatest amount of shock is transferred to the back portion of the sole of the wearer's foot, and the elastic force of the elastic plate 34 of the elastic member 300 acts more strongly at the back portion of the shoe due to the support member 40. Accordingly, it is possible to effectively absorb the shock.

Next, as described above, in the case in which the auxiliary elastic member 45, such as silicon rubber, is disposed in an empty space between the sole body 20 at the back of the support member 40 and the elastic member 30, the auxiliary elastic member 45 has sufficient flexibility, and thus is easily deformable by the external force. Accordingly, the downward movement of the sole body 20, attributable to the vertical load, and the upward movement of the elastic plate 34, which is attributable to the elastic force and acts as the fixing piece 32 serves as the support axis, are offset, and thus it is possible to flexibly absorb the shock.

On the other hand, in the state in which the shock absorption is achieved by the elastic force of the elastic member 30 as the external force attributable to the vertical load is transferred, the elastic plate 34 maintains the latent elastic force. That is, the elastic plate 34 of the elastic member 30 tends to recover to its initial state. From this state, when the back portion of the sole of the wearer's foot lifts from the ground surface for walking and the load to the wearer's foot attributable to the weight of the wearer is moved from the back portion of the foot to the front portion of the foot, the vertical load is concentrated on the front portion of the wearer's foot but the external force applied to the back portion of the wearer's foot is removed. At this time, since the force is transferred in the direction in which the elastic force of the elastic plate 34 of the elastic member 30 tends to recover, the elastic recovery force of the elastic plate 34 of the elastic member 30 acts in the downward direction around the fixing piece 32, but the sole body 20 receives the repulsive force acting in the upward direction. Accordingly, because the sole body 20 receives the force acting in the vertically upward direction at the back portion thereof, it helps the wearer walk smoothly. As described above, the elastic recovery force of the elastic plate 34 is transferred well via the back portion of the sole body 20 due to the support member 40, and moreover, the elastic recovery force is transferred better in the case in which the auxiliary elastic member 45 is included.

As described above, since the fixing piece 32 of the elastic member 30 is fixedly combined with the sole body 20 and the back part 20*b* of the sole body 20 and the elastic plate 34 of the elastic member 30 remain spaced apart from each other, the elastic plate 34 maintains the shock absorbing function thanks to the elastic force of the elastic plate 34 with respect to the external force attributable to the vertical load which is transferred, and helps the wearer walk smoothly thanks to the repulsive force attributable to the elastic recovery force. Accordingly, the shock absorbing function and the elastic reaction function, both of which are required for good shoes but which have had a tradeoff relationship to date, can be implemented at the same time in the functional shoe according to the invention.

Hereinabove, the structure and operation of the shock absorbing function of the elastic member having elastic force and the repulsive elastic function based on elastic recovery have been described with reference to the accompanying drawings. However, the description only gives only examples, so it is apparent that a variety of modifications, alterations, and changes may be possible within the scope of the technical spirit of the invention.

What is claimed is:

1. A shoe with an elastic sole member, the elastic sole member comprising:

a sole body having an upper surface and a lower surface and including a front portion and a rear portion, the rear portion generally upwardly inclined toward a rear end thereof, and the upper surface of the sole body having an opening exposed therein and formed through the lower surface of the sole body;

an elastic member formed of an elastic material and including a fixing piece and an elastic plate, the fixing piece securely affixed to the opening of the sole body and the elastic plate extending from the fixing piece in a downwardly inclined direction and through the opening of the sole body such that a space is provided between the elastic plate and the rear portion of the sole body, and wherein the elastic member is elastically deformed about the fixing piece in said space provided when an external force is applied to the rear portion of the sole body, thereby providing a shock absorbing function, and elastically restored when the external force is removed, thereby providing a repulsive elastic force to the rear portion of the sole body; and a support member disposed in the space between the elastic plate and the rear portion of the sole body, the support member being generally wedge shaped and formed of elastic material for supplementing the elastic force of the elastic member.

2. The shoe of claim 1, wherein the elastic member is made of metal or synthetic resin.

3. The shoe of claim 2, wherein an outer surface of the elastic member is coated with rubber or soft synthetic resin.

4. The shoe of claim 1, further comprising an outsole coupled to a lower surface of the elastic member.

5. The shoe of claim 1, wherein the sole body has a protruding jaw on the lower surface thereof, and the support member engages with the protruding jaw of the sole body.

6. The shoe of claim 1, wherein the opening of the sole body extends in a generally downwardly inclined direction from the upper surface of the sole body to the lower surface of the sole body.

7. The shoe of claim 1, wherein the fixing piece of the elastic member has a plurality of threaded insertion members for fixing the fixing piece to the opening of the sole body.

8. The shoe of claim 1, further comprising an insole on the upper surface of the sole body.

9. The shoe of claim 8, wherein the insole includes a groove portion with a plurality of threaded holes formed therein for threaded coupling the groove portion of the insole to the fixing piece of the elastic member.

10. The shoe of claim 9, wherein the insole further includes a cover for coupling to the groove portion of the insole.

11. The shoe of claim 1, further comprising an auxiliary elastic member having elasticity in the space formed at a rear side of the support member and between the elastic member and the sole body.

12. An elastic sole member of a shoe, comprising:

a sole body having an upper surface and a lower surface and including a front portion and a rear portion, the rear portion generally upwardly inclined toward a rear end thereof, and the upper surface of the sole body having an opening exposed therein and formed through the lower surface of the sole body;

an elastic member formed of an elastic metal or synthetic resin and including a fixing piece and an elastic plate, the fixing piece securely affixed to the opening of the sole body and the elastic plate extending from the fixing piece in a downwardly inclined direction and through the opening of the sole body such that a space is provided between the elastic plate and the rear portion of the sole body, and wherein the elastic member is elastically deformed about the fixing piece in said space provided when an external force is applied to the rear portion of the sole body, thereby providing a shock absorbing function, and elastically restored when the external force is removed, thereby providing a repulsive elastic force to the rear portion of the sole body; and a support member disposed in the space between the elastic plate and the rear portion of the sole body, the support member being generally wedge shaped and formed of elastic material for supplementing the elastic force of the elastic member.

13. The elastic sole member of claim 12, further comprising an insole on the upper surface of the sole body.

14. The elastic sole member of claim 13, wherein the insole includes a groove portion with a plurality of threaded holes formed therein for threaded coupling the groove portion of the insole to the fixing piece of the elastic member, and wherein the insole further includes a cover for coupling to the groove portion of the insole.

15. The elastic sole member of claim 12, further comprising an outsole coupled to a lower surface of the elastic member.

16. The elastic sole member of claim 12, wherein the sole body has a protruding jaw on the lower surface thereof, and the support member engages with the protruding jaw of the sole body.

17. The elastic sole member of claim 12, further comprising an auxiliary elastic member having elasticity in the space formed at a rear side of the support member and between the elastic member and the sole body.

18. The elastic sole member of claim 17, wherein the support member occupies about 30-60% of the space between the elastic member and the sole body, and the auxiliary elastic member occupies a remainder portion of the space thereof.

19. The elastic sole member of claim 12, wherein the opening of the sole body extends in a generally downwardly inclined direction from the upper surface of the sole body to the lower surface of the sole body.

* * * * *